US007684905B2

(12) United States Patent
Franckart et al.

(10) Patent No.: US 7,684,905 B2
(45) Date of Patent: Mar. 23, 2010

(54) SYSTEM AND METHOD FOR VERIFYING THE INTEGRITY OF A TRAIN

(75) Inventors: Jean-Pierre Franckart, Montignies-Sur-Sambre (BE); Eric Lechevin, Leuze-En-Hainaut (BE)

(73) Assignee: Alstom Belgium S.A., Charleroi (BE)

( * ) Notice: Subject to any disclaimer, the term of this patent is extended or adjusted under 35 U.S.C. 154(b) by 0 days.

(21) Appl. No.: 11/715,684

(22) Filed: Mar. 8, 2007

(65) Prior Publication Data

US 2007/0213890 A1 Sep. 13, 2007

(30) Foreign Application Priority Data

Mar. 9, 2006 (FR) ..... 06 02102

(51) Int. Cl.
*G05D 1/00* (2006.01)

(52) U.S. Cl. ..... 701/19; 701/20; 342/457; 342/357.02

(58) Field of Classification Search ..... 701/19, 701/20

See application file for complete search history.

(56) References Cited

FOREIGN PATENT DOCUMENTS

| | | | |
|---|---|---|---|
| DE | 197 43 631 | A1 | 6/1990 |
| DE | 44 36 996 | C1 | 3/1996 |
| DE | 199 63 258 | A1 | 6/2001 |
| EP | 1 561 663 | A | 8/2005 |
| GB | 2 225 887 | A | 6/1990 |
| WO | WO 2003/013935 | A | 2/2003 |

OTHER PUBLICATIONS

Preliminary Search Report of priority application FR 06 02102, English translation.

Heitmann, Rolf et al. "Systeme zur Zugvollstaendigkeitsueberwachung," Signal + Draht, TelzlaffVerlag GMBH, vol. 89, No. 11, pp. 22 to 25. Darmstadt, Germany: Nov. 1997. XP000779910, ISSN: 0037-4997. See English translation of Preliminary Search Report of priority application FR 06 02102.

*Primary Examiner*—Tuan C To
*Assistant Examiner*—Redhwan Mawari
(74) *Attorney, Agent, or Firm*—Davidson, Davidson & Kappel, LLC

(57) ABSTRACT

A system for verifying the integrity of a train having a predetermined length including: a device for communicating and synchronising with a detector of a circuit, detecting the presence/absence of a train, an odometer providing an odometric reference at the start of occupation of the circuit and when the circuit is left by the train, a first processor calculating the distance travelled by the train on the basis of the difference between the two odometric references, a second processor calculating a minimum estimate of the length of the train that is equal to the calculated distance travelled less the algebraic length of the detection circuit, information mechanism indicating that the train is integral when the calculated length of the train is greater than the predetermined length of the train less the length of a wagon.

12 Claims, 3 Drawing Sheets

SYSTEM AND METHOD FOR VERIFYING THE INTEGRITY OF A TRAIN

This application claims the benefit of French Application No. 06 02102 filed Mar. 9, 2006, the entire disclosure of which is hereby incorporated by reference herein.

TECHNICAL FIELD

The present invention relates to a system and a method for verifying the integrity of a train.

BACKGROUND TO THE INVENTION

Verifying the integrity of a train involves monitoring that the train has not lost any wagons.

Currently, that verification operation is carried out by devices which are specially configured for the purpose and which are installed along the tracks and which are suitable for counting the number of axles of the train.

These devices are troublesome because they require specific adaptation of the track.

SUMMARY OF THE INVENTION

Therefore, the problem addressed by the invention is to provide a system and a method for verifying the integrity of a train which have a reduced cost whilst at the same time ensuring the necessary safety to comply with railway standards.

The invention provides a system for verifying the integrity of a train having a predetermined length, the system being provided on-board the train and including:

a device for communicating and synchronising with a detector of a detection circuit, the detector being able to detect the presence/absence of a train on the detection circuit, an odometer connected to the communication and synchronisation device that provide an odometric reference at the start of occupation of the detection circuit by the train and when the detection circuit is left by the train, a first processor calculating the distance travelled by the train between the occupation start time and the leaving time on the basis of the difference between the two odometric references, a second processor calculating a minimum estimate of the length of the train, the estimate being equal to the calculated distance travelled less the length of the detection circuit, integrity information mechanism which is able to transmit a piece of information indicating that the train is integral when the calculated length of the train is greater than the predetermined length of the train less the length of a wagon.

Other features may include:

the odometer having a predetermined relative uncertainty, the calculated distance travelled is expressed in the form of a confidence interval between a minimum distance and a maximum distance so that the probability that the train has not travelled a distance included within that confidence interval is less than a probability that is compatible with railway safety standards, and the length of the train is then calculated as the difference between the minimum distance and the length of the detection circuit;

it includes another device validating the measurement such that, if the predetermined length of the train is greater than the maximum length of the train, that maximum length measured being calculated as the difference between the maximum distance and the length of the detection circuit, then the measurement of distance travelled is considered to be invalid;

the detection circuit includes a first short track circuit and a second short track circuit which is spaced apart by a predetermined distance from the first short track circuit, which distance is less than the predetermined length of the train, and is located downstream of the first short track circuit in relation to the direction of travel of the train, each short track circuit including a detector detecting the presence of the train, the start of occupation of the detection circuit corresponding to the start of occupation of the second short track circuit, leaving the detection circuit corresponding to leaving the first short track circuit, the length of the detection circuit being equal to the distance between the two short track circuits, and the calculated length being the sum of the length of the detection circuit and the distance calculated; and the detection circuit includes a short track circuit including a detector detecting the presence of the train, the start of occupation of the detection circuit corresponding to the start of occupation of the short track circuit, and leaving the detection circuit corresponding to leaving the short track circuit, and the length of the detection circuit being equal to the length of the short track circuit.

The invention also provides a method for verifying the integrity of a train having a predetermined length when the train passes over a detection circuit having a predetermined length, and the train having on-board odometry, and the method including the steps of:

a) storing the odometric reference of the train at the time at which occupation of the detection circuit by the train starts,
b) storing the odometric reference of the train at the time at which the detection circuit is left by the train,
c) calculating the distance travelled by the train between the occupation start time and the leaving time on the basis of the difference between the two odometric references previously stored,
d) calculating the length of the train, the length being equal to the calculated distance travelled less the length of the detection circuit,
e) verifying the integrity of the train by verifying that the calculated length is greater than the predetermined length of the train less the length of a wagon.

Other features may include:

the odometer having a predetermined relative uncertainty, the distance travelled is expressed in the form of a confidence interval between a minimum distance and a maximum distance such that the probability that the train has not travelled a distance included within that confidence interval is less than a probability that is compatible with railway safety standards, and the length of the train is calculated as the difference between the minimum distance and the length of the detection circuit;

prior to step e), it includes a step for validating the measurement such that, if the predetermined length of the train is greater than the maximum length of the train, that maximum length being calculated as the difference between the maximum distance and the length of the detection circuit, then the measurement of distance travelled is considered to be invalid and step e) for verifying the integrity is not carried out;

the detection circuit includes a first short track circuit and a second short track circuit that is spaced apart by a predetermined distance from the first short track circuit, which distance is less than the predetermined length of the train, and is located downstream of the first short track circuit in relation to the direction of travel of the train, each short track circuit including a detector detecting the presence of the train, the start of occupation of the detection circuit corresponding to the start of occupation of the second short track circuit, leaving the detection circuit corresponding to leaving the first short track circuit, the length of the detection circuit being equal to the distance between the two short track circuits, and the calculated length being the sum of the length of the detection circuit and the calculated distance; and the detection circuit includes a short track circuit including means for detecting the presence of the train, the start of occupation of the detection circuit corresponding to the start of occupation of the short track circuit, and leaving the detection circuit corresponding to leaving the short track circuit, and the length of the detection circuit being equal to the length of the short track circuit.

Another aspect is a computer programme product including programme code instructions for carrying out the steps of the method when the programme operates on a computer.

Another aspect is a system for verifying the integrity of a train having a predetermined length including:

a verification system provided on-board the train; and at least one device for detecting by means of a track circuit, the device being suitable for detecting the presence/absence of a train on the track circuit, and including a device for communicating and synchronising with the on-board verification system in order to transmit to that system the start or end time of occupation of the track circuit by the train.

BRIEF DESCRIPTION OF THE DRAWINGS

The invention will be better understood from a reading of the following description, given purely by way of example and with reference to the appended drawings in which.

DESCRIPTION OF PREFERRED EMBODIMENTS

Figure 1:
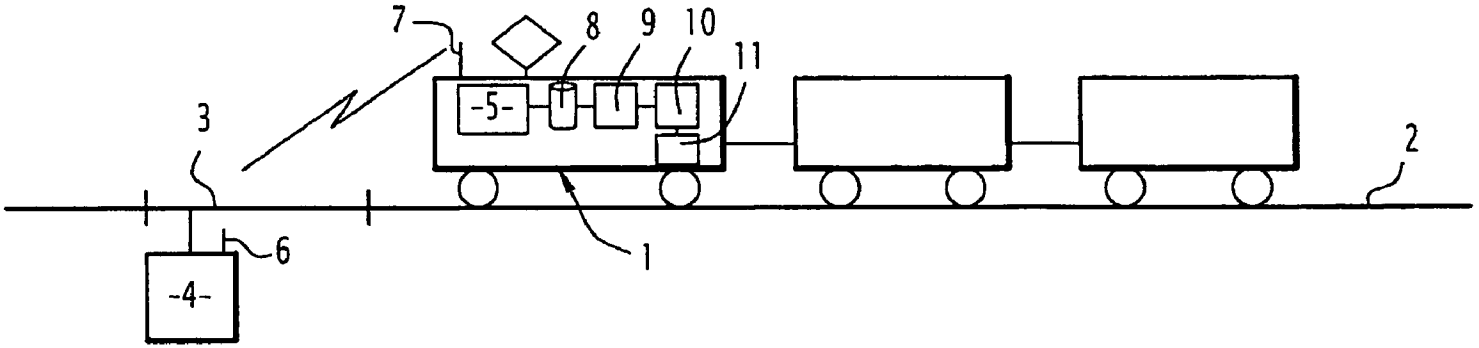
FIG. 1 is a schematic illustration of a train on a track, the train being provided with the integrity verification system.

With reference to FIG. 1, a train 1 travels on a railway track 2 including a detection circuit. In the embodiment described, this circuit is formed by a short track circuit 3.

Conventionally, the term track circuit is intended to refer to the electrical circuit of a completely delimited track portion of known length, which is electrically isolated and which allows occupation of portions of track or points to be monitored.

A short track circuit corresponds to a track portion whose length is minimised, whilst at the same time ensuring that, when a train passes, at least one axle of the train is permanently located on the track portion. For simplicity, the electrical circuit and the corresponding track portion will both be referred to as the short track circuit.

The short track circuit 3 includes a detector 4 for detecting the presence of a train thereon.

The train 1 includes an odometer 5.

That odometer 5 indicates the distance travelled by the train with a relative uncertainty which is known to the manufacturer. As a general rule, odometers mounted on trains have a relative uncertainty of ±2%.

The short track circuit 3 and the train 1 also include communication devices 6, 7 which allow them to exchange information. Those communication devices 6, 7, may be, for example, radio communication devices, or devices communicating by a carrier current on the rails, or any other suitable system.

Those communication device 6, 7 is suitable for allowing synchronisation between the events involving the start of the presence of the train on the short track circuit 3 and the train 1 leaving the short track circuit 3 and the odometer 5, so that the odometer 5 establishes the odometric values corresponding to those two events.

The train includes storage 8 for storing the odometric values established by the odometer 5.

The train also includes a first processor 9 for calculating the distance travelled by the train between the occupation start time and the leaving time.

A second processor 10 establishing the minimum length of the train is connected to the first processor 9 for calculating the distance.

The train also includes integrity information mechanism 11 for warning the driver, for example.

In a preferred embodiment, the storage, first processor and second processor 8, 9 and 10 are integrated in an on-board processor on the train.

The operation of the system will now be explained with reference to FIGS. 2 and 3.

Figure 2:
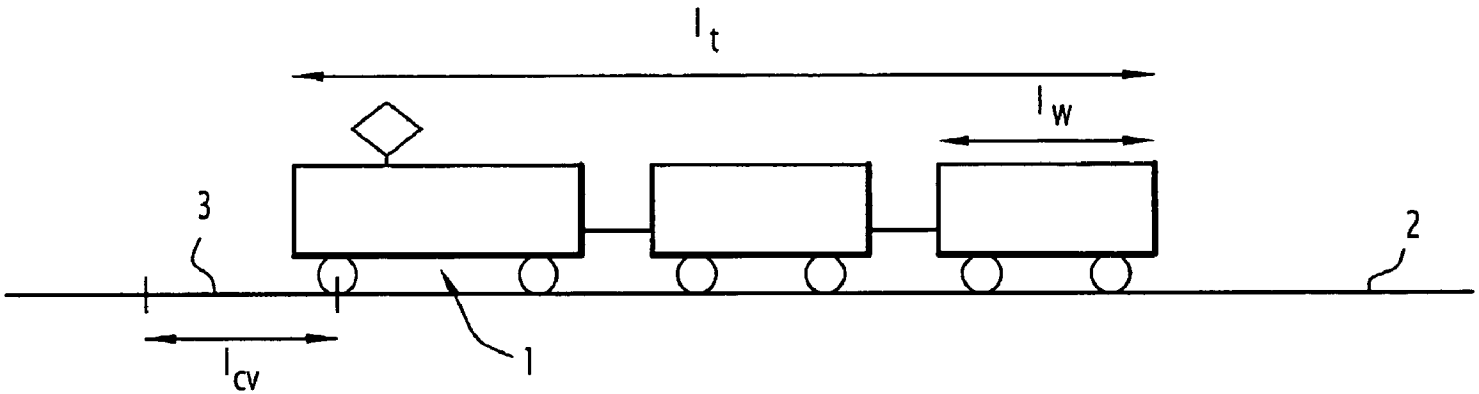
FIG. 2 is a schematic illustration of a train entering a short track circuit.

FIG. 2 illustrates the time at which the train 1 begins to occupy the short track circuit 3, that is to say that its first axle enters the short track circuit 3.

At that moment, the odometer 5 indicates an odometric reference $D_1$.

The short track circuit 3 has a length $l_{CV}$, the train has a length $l_t$ and the last wagon has a length $l_W$.

Figure 3:
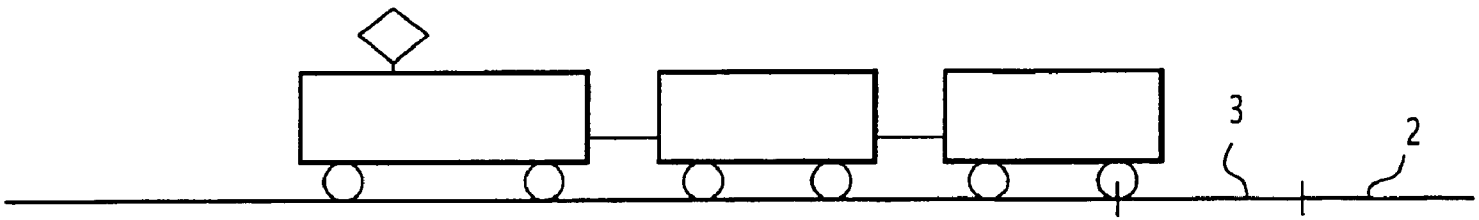
FIG. 3 is a schematic illustration of a train leaving a short track circuit.

FIG. 3 illustrates the time at which the train 1 leaves the short track circuit 3.

At that moment, the odometer 5 indicates an odometric reference $D_2$.

In this manner, in the absence of uncertainty, the distance travelled $D_2-D_1$ is equal to the length of the train $l_t$ plus the length $l_{CV}$ of the short track circuit, or $$l_t=D_2-D_1-l_{CV} \quad (1).$$

Without any detriment to the general nature of the system, and for the sake of simplicity, the axles are assumed to be positioned at the front and rear ends of the train. It may readily be appreciated that the length of the short track circuit 3 has a length greater than the maximum distance between two axles so that at least one axle is located within the short track circuit for the entire duration of the passage of the train.

The length $l_{CV}$ of the short track circuit is totally known and is stored in the processing means of the train. For example, the communication means 6 of the short track circuit 3 transmitted to the train the value $l_{CV}$ in a prior initialisation step.

Conversely, the odometric values $D_1$ and $D_2$ include uncertainties linked to the odometer 5, the precision of synchronisation between the detector 4 of the short track circuit and the odometer 5, and the delays linked to the leaving or occupation times of the tracks.

Knowing the various uncertainties of the measurements, the first and second processors establish an interval of distances ($D_{min}$, $D_{max}$) such that the probability that the distance travelled by the train is not within that interval is less than a probability that is compatible with railway safety standards, for example, $10^{-12}$.

Therefore, the measured length of the train varies, in accordance with equation (1), between $D_{min}-l_{CV}$ and $D_{max}-l_{CV}$, with $D_{min}$ corresponding to the minimum value of $D_2-D_1$ and $D_{max}$ corresponding to the maximum value thereof. In general, $D_{min}=D_{2min}-D_{1max}$ and $D_{max}=D_{2max}-D_{1min}$. In some types of odometry, however, $D_{min}$ may be equal to $D_{2min}-D_{1min}$ and $D_{max}$ equal to $D_{2max}-D_{1max}$.

The second processor 10 compares the measured length with the predetermined length $l_t$ less the length of the wagon $l_W$.

If the minimum length measured $D_{min}-l_{CV}$ is greater than or equal to the predetermined length of the train less the length of a wagon $l_t-l_W$, then the train is integral. That integrity information can be used to start the preceding action.

If, however, the minimum length measured is less than the predetermined length of the train less the length of a wagon, then the train is considered not to be integral.

The system described in this manner therefore advantageously allows the integrity of a train to be detected at reduced cost because the short track circuits are already installed on tracks in order to detect the presence or absence of a train and new trains currently in operation include on-board odometers.

In one embodiment, an on-board processor which is specially programmed and connected to the odometer 5 and the sensor 4 for monitoring the short track circuit allow the calculations to be carried out and the integrity information to be transmitted.

Figure 4:
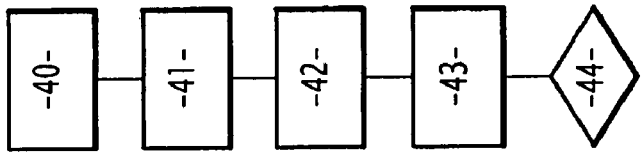
FIG. 4 is a flow chart of the method for verifying the integrity of a train.

The computer programme carries out the following method, FIG. 4:

a) storing at 40 the odometric reference D1 of the train at the time at which occupation of the short track circuit by the train starts, b) storing at 41 the odometric reference D2 of the train at the time at which the short track circuit is left by the train, c) calculating at 42 the distance travelled by the train between the occupation start time and the leaving time on the basis of the difference between the two odometric references previously stored, that is to say, $D_2-D_1$. As previously explained, that distance is expressed in the form of a confidence interval between a minimum distance and a maximum distance such that the probability that the train has not travelled a distance included within that confidence interval is less than a probability that is compatible with railway safety standards, d) calculating at 43 the minimum length of the train, the length being equal to the calculated minimum distance travelled less the length of the short track circuit, e) verifying at 44 the integrity of the train by verifying that the minimum length calculated is greater than the predetermined length of the train less the length of a wagon.

Figure 5:
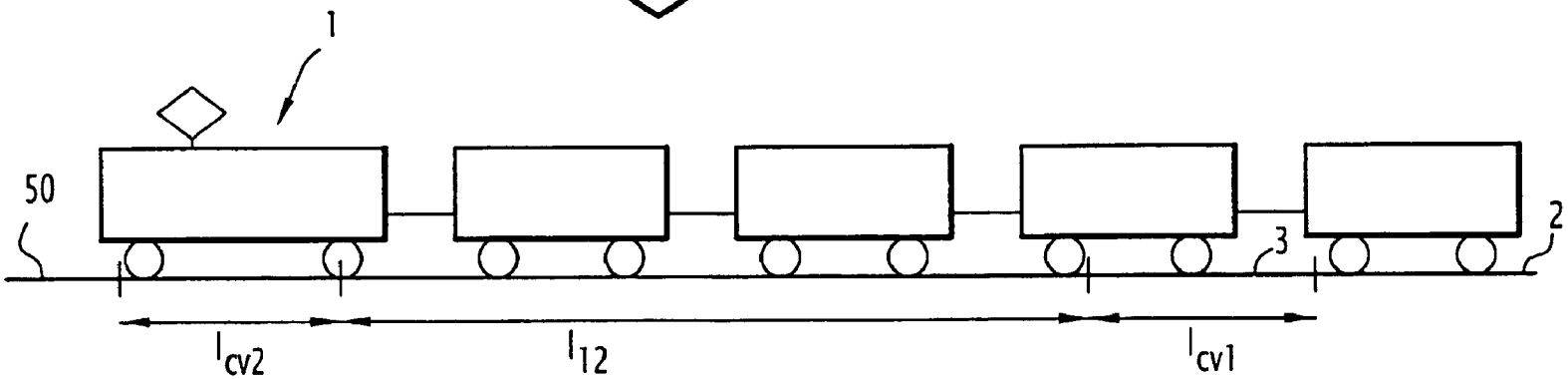
FIG. 5 is a schematic illustration of a variant of the verification system or method.

In a variant, FIG. 5, two short track circuits 3, 50 which are spaced apart by a length $l_{12}$ are used in order to delimit the detection circuit, so that the length $l_{12}$ is less than the length of the train.

The measurement times of the odometric references correspond to the time at which the train 1 enters the second short track circuit 50 and the time at which it leaves the first short track circuit 3, the first one therefore being located upstream of the second short track circuit 50 in relation to the travel of the train.

The assembly behaves similarly to the short track circuit of the preceding embodiment, in which equation (1) becomes $$l_t=D_2-D_1+l_{12} \quad (2)$$

The calculated length of the train is equal to the sum of the minimum distance travelled and the distance between those two short track circuits and is therefore independent of the length of the short track circuits.

That construction variant allows, with the measured distance travelled being increased, the uncertainty of the measurement may be reduced and therefore the precision of the detection system may be increased.

Figure 6:
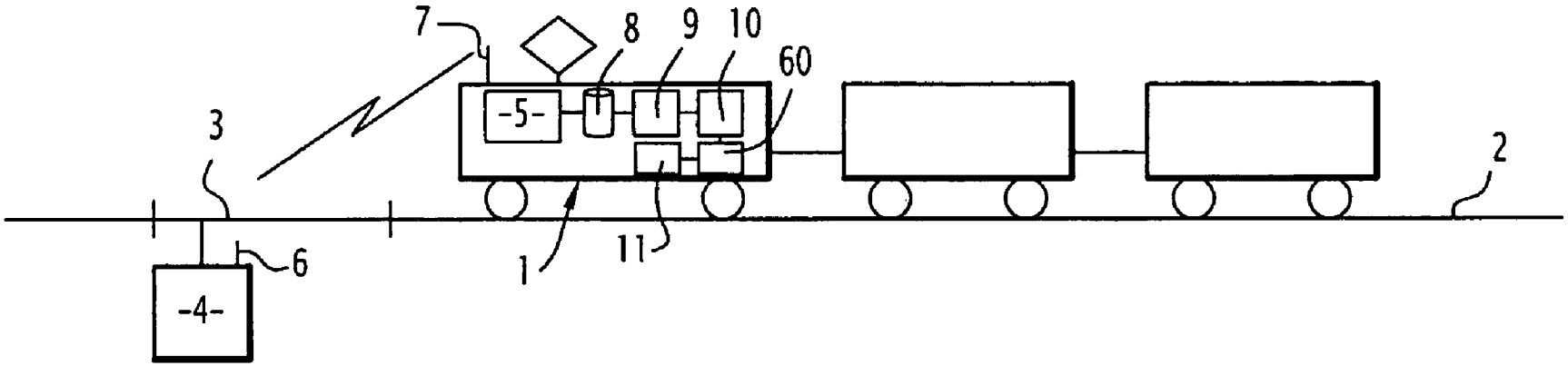
FIG. 6 is a schematic illustration of a variant of the verification system.

In a second construction variant, FIG. 6, the system includes device 60 for validating the measurement.

The device 60 uses the maximum distance travelled $D_{max}$.

According to equation (1), the measured length of the train is within the interval $(D_{min}-l_{CV}, D_{max}-l_{CV})$.

If the predetermined length of the train is greater than $D_{max}-l_{CV}$, or greater than $D_{max}$, the validation means 60 conclude that the measurement is invalid and trigger an alarm.

That variant may advantageously be used when the train set is being constituted in a marshalling yard, as a supplement to a conventional system for counting wagons in order to validate the system for monitoring integrity.

In a third variant, the short track circuits are suitable for transmitting the occupation/leaving detection information accompanied by the time at which that action involving occupation/leaving was carried out. The precision of the system is increased by reducing the uncertainties of the odometric values $D_1$ and $D_2$ linked to the transmission times of the signal.

The system and the method described in this manner therefore advantageously may allow verification of the integrity of trains at reduced cost by using pre-existing elements on railway networks and traction machines.

In other words, the length $l_{CV}$ of the track circuit used in the equation (1) of the embodiment of FIG. 1 and the distance between the two short track circuits-$l_{12}$ used in equation (2) correspond to a generic term referred to as algebraic shift of the length of the detection circuit, the detection circuit being able to be described as a track segment orientated in the direction of travel of the train. The algebraic shift of the length of the detection circuit translates a predetermined algebraic bias which is involved in the calculation of the length of the train.

In a variant, the method carried out by the computer programme includes prior to step e) a step including:

f) verifying that the predetermined length of the train is greater than an augmented minimum measured length of the train, this augmented minimum measured length being calculated as the difference between the minimum distance and the algebraic shift of the length of the detection circuit increased by the length of a vehicle, the vehicle being either a wagon or a car.

In case the result of the verification test carried out in the step f) is positive, the train is suspected not to be integral and the step e) is not executed.

What is claimed is:

1. A system for verifying the integrity of a train having a predetermined length, the system being fitted on-board the train and comprising:

a device communicating and synchronizing with a detector of a detection circuit, the detector detecting a presence or absence of a train on the detection circuit;

an odometer connected to the communication and synchronization device and having a predetermined uncertainty, the odometer providing a first and second odometric reference at an occupation start time and a leaving time, the occupation start time being when the train occupies the detection circuit and the leaving time being when the train leaves the detection circuit;

a first processor calculating the distance traveled by the train between the occupation start time and the leaving time based on a difference between the first and second odometric references;

a second processor calculating an estimate of the length of the train, the estimate being equal to the sum of the calculated distance traveled and a length of the detection circuit; and an integrity information mechanism transmitting information indicating the train is complete when the calculated length of the train is greater than the predetermined length of the train less the length of a wagon;

wherein, since the odometer has the predetermined uncertainty, the calculated distance traveled is expressed in the form of a confidence interval between a minimum distance and a maximum distance so that a probability that the train has not traveled a distance included in this confidence interval is smaller than a predetermined probability, and the length of the train is calculated as the sum of the minimum distance and the length of the detection circuit.

2. The system for verifying the integrity of a train as recited in claim 1 further comprising a device validating the measurement such that, if a predetermined length of the train is greater than a maximum length of the train, that maximum length measured being calculated as a sum of the maximum distance and the length of the detection circuit, then the measurement of distance traveled is invalid.

3. The system for verifying the integrity of a train according to claim 1 further comprising a device validating the measurement such that, if a predetermined length of the train is greater than an augmented minimum measured length of the train, the augmented minimum measured length being calculated as a difference between the minimum distance and the algebraic shift of the length of the detection circuit increased by a length of a vehicle, then the train is not integral.

4. The system for verifying the integrity of a train as recited in claim 1 wherein the detection circuit includes a first short track circuit and a second short track circuit, the second short track circuit being spaced apart by a predetermined distance from the first short track circuit, the predetermined distance being less than the predetermined length of the train, the second short track circuit being located downstream of the first short track circuit with respect to a direction of travel of the train, the first and second short track circuits each including a detector detecting the presence of the train, the start of occupation of the detection circuit corresponding to a start of occupation of the second short track circuit, leaving the detection circuit corresponding to leaving the first short track circuit, the length of the detection circuit is equal to the predetermined distance between the first and the second short track circuits.

5. The system for verifying the integrity of a train as recited in claim 1 wherein the detection circuit includes a short track circuit including a detector detecting the presence of the train, a start of occupation of the detection circuit corresponding to the start of occupation of the short track circuit, and leaving the detection circuit corresponding to leaving the short track circuit, and the algebraic shift of the length of the detection circuit being equal to the algebraic length of the short track circuit, the algebraic length of the short track circuit being equal to the measurement, with respect to a direction of travel of the train, of the vector having a start point being the point the short track circuit is left and an end point being the occupation start point of the short track circuit.

6. A system for verifying the integrity of a train having a predetermined length comprising:

an on-board verification system on the train as recited in claim 1, and at least one detector detecting via a track circuit the presence or absence of a train on the track circuit, and including a device communicating and synchronizing with the on-board verification system to transmit to the verification system the start or end time of occupation of the track circuit by the train.

7. A system for verifying the integrity of a train having a predetermined length, comprising:

a detector of a detection circuit, the detector detecting a presence or absence of a train on the detection circuit, the detection circuit having a predetermined length;

a device communicating and synchronizing with the detection circuit;

an odometer connected to the communication and synchronization device and having a predetermined uncertainty, the odometer providing a first and second odometric reference at an occupation start time and a leaving time;

at least one processor for calculating a minimum length distance and a maximum length distance traveled by the train between the occupation start time and the leaving time based on a difference between the first and second odometric references and a predetermined uncertainty of the system and for estimating the length of the train, the estimate being equal to the sum of the calculated minimum length distance and the predetermined length of the detection circuit; and an integrity information mechanism transmitting information indicating the train is complete when the estimated length of the train is greater than the predetermined length of the train less the length of a wagon.

8. The system of claim 7, wherein the predetermined uncertainty of the system comprises a predetermined uncertainty of a measurement by the odometer.

9. The system of claim 8, wherein the predetermined uncertainty of the measurement by the odometer comprises at least one of the predetermined uncertainty of the odometer and the precision of synchronization of the detection circuit and the odometer.

10. The system of claim 7, wherein the occupation start time is when the train occupies the detection circuit and the leaving time being when the train leaves the detection circuit.

11. The system of claim 7, further comprising a validating device which determines that the length measurement is invalid when the predetermined length of the train is greater than the sum of the maximum length distance and the predetermined length of the detection circuit.

12. The system of claim 7 wherein the detection circuit includes a first short track circuit and a second short track circuit, the second short track circuit being spaced apart by a predetermined distance from the first short track circuit, the predetermined distance being less than the predetermined length of the train, the second short track circuit being located downstream of the first short track circuit with respect to a direction of travel of the train, the first short track circuit including a first detector detecting the presence of the train on the first short track circuit, the second short track circuit including a second detector detecting the presence of the train on the second short track circuit, the occupation start time corresponding to a start of occupation of the second short track circuit, the leaving time corresponding to leaving the first short track circuit, the predetermined length of the detection circuit equal to the predetermined distance between the first and the second short track circuits.

* * * * *